US012698585B2

(12) United States Patent
Kim et al.

(10) Patent No.: US 12,698,585 B2
(45) Date of Patent: Aug. 4, 2026

(54) LAUNDRY TREATMENT APPARATUS

(71) Applicant: LG Electronics Inc., Seoul (KR)

(72) Inventors: Jaehyung Kim, Seoul (KR); Semin Jang, Seoul (KR); Jinhyuk Jang, Seoul (KR); Boram Noh, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/778,313

(22) Filed: Jul. 19, 2024

(65) Prior Publication Data

US 2024/0368822 A1 Nov. 7, 2024

Related U.S. Application Data

(63) Continuation of application No. 18/330,046, filed on Jun. 6, 2023, now Pat. No. 12,077,900, which is a (Continued)

(30) Foreign Application Priority Data

May 7, 2020 (KR) ..... 10-2020-0054330

(51) Int. Cl.
*D06F 71/29* (2006.01)
*D06F 71/04* (2006.01)
(Continued)

(52) U.S. Cl.
CPC ..... *D06F 71/29* (2013.01); *D06F 71/04* (2013.01); *D06F 71/34* (2013.01); *D06F 71/40* (2013.01); *D06F 87/00* (2013.01)

(58) Field of Classification Search
CPC ..... D06F 71/29; D06F 71/04; D06F 71/34; D06F 71/40; D06F 71/36; D06F 87/00; D06F 73/02; D06F 58/10
See application file for complete search history.

(56) References Cited

U.S. PATENT DOCUMENTS 3,439,845 A 4/1969 Lester, Jr.
5,305,484 A * 4/1994 Fitzpatrick ..... D06F 73/02 68/6
(Continued)

FOREIGN PATENT DOCUMENTS

CN 103314151 A 9/2013
CN 105193214 A 12/2015
(Continued)

OTHER PUBLICATIONS

Office Action in Chinese Appln. No. 202210751800.1, mailed on Jan. 15, 2025, 16 pages (with English translation).
(Continued)

*Primary Examiner* — Uyen T Nguyen
(74) *Attorney, Agent, or Firm* — Fish & Richardson P.C.

(57) ABSTRACT

A laundry treating apparatus includes a cabinet having a laundry inlet, a first chamber positioned inside the cabinet, a second chamber positioned underneath the first chamber, a steamer disposed inside the second chamber to generate steam and supply the generated steam to the first chamber, a door pivotably coupled to the cabinet to open and close the laundry inlet, a door inner surface facing the first chamber among both surfaces of the door, a base plate coupled to the door inner surface, a first shaft disposed parallel to a height direction of the door, a second shaft disposed perpendicular to the height direction of the door, a first pressurizing plate pivotably coupled to the door inner surface or the base plate through the first shaft and disposed to face the base plate, and a second pressurizing plate pivotably coupled to the door inner surface or the base plate.

17 Claims, 8 Drawing Sheets

Related U.S. Application Data continuation of application No. 17/365,579, filed on Jul. 1, 2021, now Pat. No. 11,708,661.

(51) Int. Cl.

| | |
|---|---|
| ***D06F 71/34*** | (2006.01) |
| ***D06F 71/40*** | (2006.01) |
| ***D06F 87/00*** | (2006.01) |

(56) References Cited

U.S. PATENT DOCUMENTS

| | | | | |
|---|---|---|---|---|
| 5,359,792 | A | 11/1994 | Hanada et al. | |
| 8,584,384 | B2 | 11/2013 | Savenok | |
| 9,309,618 | B2 | 4/2016 | Park et al. | |
| 2015/0159315 | A1* | 6/2015 | Lim | D06F 71/36 38/3 |
| 2018/0135236 | A1 | 5/2018 | Lim et al. | |
| 2018/0135237 | A1* | 5/2018 | Yoon | D06F 71/36 |
| 2018/0148887 | A1* | 5/2018 | Choi | D06F 58/10 |
| 2019/0257025 | A1 | 8/2019 | Park | |
| 2019/0368115 | A1 | 12/2019 | Kim et al. | |

FOREIGN PATENT DOCUMENTS

| | | | | | |
|---|---|---|---|---|---|
| CN | 105234927 | A | | 1/2016 | |
| CN | 110552133 | A | | 12/2019 | |
| CN | 209713559 | U | | 12/2019 | |
| CN | 210215935 | U | | 3/2020 | |
| CN | 111074515 | | | 4/2020 | |
| EP | 2889426 | | | 7/2015 | |
| EP | 3321413 | | | 5/2018 | |
| EP | 3575480 | | | 12/2019 | |
| JP | S46-014504 | Y1 | | 5/1971 | |
| JP | 58-81094 | A | | 5/1983 | |
| JP | 58-81098 | A | | 5/1983 | |
| JP | H-115000 | | | 1/1999 | |
| JP | 2016-150177 | A | | 8/2016 | |
| KR | 10-2012-0091799 | | | 8/2012 | |
| KR | 20120091799 | A | * | 8/2012 | D06F 59/02 |
| KR | 10-2015-0009718 | A | | 1/2015 | |
| KR | 10-2018-0052955 | A | | 5/2018 | |
| KR | 10-2018-0052956 | A | | 5/2018 | |
| KR | 20180052956 | | * | 5/2018 | D06F 71/18 |
| KR | 10-2018-0094822 | A | | 8/2018 | |
| KR | 10-2019-0101172 | A | | 8/2019 | |
| KR | 10-2019-0137440 | A | | 12/2019 | |
| KR | 10-2099179 | | | 4/2020 | |
| RU | 2807153 | C1 | | 11/2023 | |
| WO | WO 9402057 | A1 | | 2/1994 | |

OTHER PUBLICATIONS

Office Action in Korean Appln. No. 10-2020-0054330, mailed on Mar. 8, 2025, 8 pages (with English translation).

Notice of Allowance in Korean Appln. No. 10-2020-0054330, mailed on May 16, 2025, 3 pages (with English translation).

Office Action in Japanese Appln. No. 2021-110376, mailed on May 27, 2025, 10 pages (with English translation).

Extended European Search Report in European Appln. No. 21183097.1, dated Nov. 29, 2021, 8 pages.

Office Action in Australian Appln. No. 2022204559, mailed on Oct. 27, 2023, 7 pages.

Office Action in Japanese Appln. No. 2021-110376, mailed on Nov. 5, 2024, 11 pages (with English translation).

* cited by examiner

LAUNDRY TREATMENT APPARATUS

CROSS-REFERENCE TO RELATED APPLICATIONS

This application is a continuation of U.S. application Ser. No. 18/330,046, filed on Jun. 6, 2023, which is a continuation of U.S. application Ser. No. 17/365,579, filed on Jul. 1, 2021, now U.S. Pat. No. 11,708,661, which claims the benefit of priority to Korean Application No. 10-2020-0054330, filed on May 7, 2020, the disclosures of which are incorporated by reference in their entirety.

TECHNICAL FIELD

The present disclosure relates to a laundry treating apparatus. More particularly, the present disclosure relates to an apparatus for removing wrinkles of laundry.

BACKGROUND

A laundry treating apparatus refers to an apparatus developed for washing and drying laundry and removing wrinkles generated on the laundry at home and at a laundry. Apparatuses classified as the laundry treating apparatus include a washing machine that washes the laundry, a dryer that dries the laundry, a washing machine/dryer having both a washing function and a drying function, a laundry manager that refreshes the laundry, a steamer that removes the wrinkles from the laundry, and the like.

The steamer is an apparatus that supplies steam to the laundry to remove the wrinkle generated on the laundry. Unlike a regular iron, the steamer is an apparatus that removes the wrinkles by applying heat to the laundry through convection rather than directly applying the heat to the laundry (e.g., in a scheme of contacting the laundry with a hard object).

On the other hand, the laundry manager is an apparatus that allows the laundry to be kept tidy and clean. The laundry manager may remove fine dust attached to the laundry, deodorize the laundry, dry the laundry, and add fragrance to the laundry. In addition, the laundry manager may prevent generation of static electricity, remove the wrinkles generated on the laundry using dehumidified air or steam, and sterilize the laundry.

According to Korea Patent No. 10-2099179, the laundry treating apparatus may deodorize the laundry and remove folds at the same time by supplying hot air to a supplier located at a bottom of a cabinet or by pressurizing the laundry while the laundry is mounted in an accommodating space defined inside the cabinet.

In addition, in the laundry treating apparatus, the laundry was able to be dried and deodorized or the folds was able to be removed as the hot air or the steam is supplied to the laundry treating apparatus in a state in which the laundry is unfolded by a self load thereof at a location inside the cabinet. In addition, as a surface of the laundry is pressurized with a presser disposed on an inner surface of a door, the folds of the laundry was able to be effectively removed, creases were able to be formed on the laundry, and ironing was able to be omitted after washing or drying is completed.

In particular, the laundry treating apparatus removes the unnecessary wrinkles or folds using the steam, and has means referred to the presser or a pants press that generates predetermined creases or pleats (wrinkles intended from a clothing design step) disposed on the inner surface of the door.

However, the presser is constructed to pressurize the laundry through rotation starting from one side of the laundry. Therefore, because the presser pressurizes the laundry starting from one side of the laundry, there is no choice for the presser but to pressurize the laundry sequentially from one side to the other side thereof. In this case, a relatively high pressure is applied to a portion of the laundry close to the presser, and a relatively low pressure is applied to a portion of the pressurized portion far from the presser, so that there was a problem that the laundry was not evenly pressurized.

Further, in the process of the laundry being pressurized by the presser, there was a problem in that a fixed shape of the laundry is changed or a position thereof is changed as the laundry is pushed by the presser.

In addition, there was a problem in that the position of the laundry is not able to be prevented from being changed when the laundry is pressurized because the laundry is not able to be fixed even after being mounted. In addition, the conventional laundry treating apparatus had problems in that more wrinkles of the laundry occur or wrinkles in a direction completely different from an intended direction occur.

In addition, there was a problem that a vertical level of mounting the laundry through the door is high. In addition, there was a problem that not only the presser occupies most of the inner surface of the door, but also pressurizes only a portion of an entire length of the laundry.

SUMMARY

The present disclosure is to reduce a frequency of unintentional wrinkles or folds occurring as laundry is pressurized from one side thereof.

In addition, the present disclosure is to uniformly pressurize laundry to remove folds or unintentional wrinkles of the laundry and to improve formation of predetermined intended creases.

In addition, the present disclosure is to pressurize an entire region of laundry.

In addition, the present disclosure is to further facilitate mounting of laundry to be pressurized.

In order to reduce a phenomenon in which pants are pushed that occurs in a conventional pants manager that is opened and closed in a left and right direction, the present disclosure is to implement a sliding motion on a pants manager door (or a second pressurizing plate). That is, the pants manager door may ascend by being pivoted or slid. At this time, a first pressurizing plate (or a sub-plate) and a base plate (or a rear plate) are spaced apart from each other. Conversely, when the door is pressurized to descend by being pivoted or slid, an entire region of the pants mounted on the first pressurizing plate is simultaneously pressurized, which has an effect of ameliorating the phenomenon in which the pants are pushed.

The door includes a locking device for pressing the pants. Unlocking of the locking device may be operated by a handle disposed on the door. When using the pants manager, the door and the first pressurizing plate may respectively include openings in order to facilitate penetration of steam into the pants, and may include a hinge for opening and closing the door in a vertical direction.

The first pressurizing plate or the sub-plate, which is a structure for installing the pants, has a hinge structure capable of a movement in a vertical direction and a pivoting in a left and right direction of the sub-plate. The movement in the vertical direction is in association with the pants manager door, so that the sub-plate automatically slides upward when the door is lifted. Thereafter, because the sub-plate has the hinge structure to pivot in one of the left and right directions, after pivoting and opening the sub-plate as shown in FIG. 4C, the pants are installed. A more detailed sliding hinge structure will be illustrated in FIGS. 6A to 7C. In addition, the sub-plate has fixing clips that may fix a pant waist and a hem of the pants on both surfaces thereof. In addition, the sub-plate has fixing clips that may fix a pant waist and a hem of the pants on both surfaces thereof.

An installation process of the pants is as follows. When the handle installed at a lower end of the door is pulled to unlock the locking device, and the door is lifted upward and is fixed, the sub-plate on which the pants may be mounted is exposed. In order to install the pants, after pivoting the sub-plate in one direction, the hem of the pants is fixed by the fixing clip (or a first clip) installed on a rear surface of the sub-plate. The fixing clip has a structure that may be installed variably depending on a length of the pants. After fixing the hem of the pants, the pant waist is fixed by the fixing clip (or a second clip) installed on a front surface of the sub-plate.

After the pants installation is complete, the sub-plate is pivoted to be in an original state thereof, and the door of the pants manager is closed such that a pressure may be applied to the pants.

One aspect of the present disclosure provides a laundry treating apparatus including a cabinet having a laundry inlet defined in one surface thereof, a first chamber positioned inside the cabinet to accommodate laundry therein through the laundry inlet, a second chamber positioned underneath the first chamber to define a space separated from a space of the first chamber, a steamer disposed inside the second chamber to generate steam and supply the generated steam to the first chamber, a door pivotably coupled to the cabinet to open and close the laundry inlet, a door inner surface facing the first chamber among both surfaces of the door, a base plate coupled to the door inner surface, a first shaft disposed parallel to a height direction of the door, a second shaft disposed perpendicular to the height direction of the door, a first pressurizing plate pivotably coupled to the door inner surface or the base plate through the first shaft and disposed to face the base plate, wherein the first pressurizing plate mounts and pressurizes pants, and a second pressurizing plate pivotably coupled to the door inner surface or the base plate through the second shaft and disposed to face the first pressurizing plate.

In one implementation, the first pressurizing plate may include a first clip located at a lower portion of one surface thereof facing the base plate, wherein the first clip fixes one of a hem and a pant waist of the pants.

In one implementation, the first pressurizing plate may include a second clip located at a lower portion of the other surface thereof facing the second pressurizing plate, wherein the second clip fixes the other of the hem and the pant waist of the pants.

In one implementation, the second clip may be formed as a clip of an angled shape to define a predetermined gap with the first pressurizing plate, and the second clip may fix the pants by inserting a portion of one side surface of the pants into the predetermined gap.

In one implementation, because a length of the second pressurizing plate is smaller than a length of the first pressurizing plate, the second clip may be exposed out of the first pressurizing plate when the second pressurizing plate is pivotably coupled to the first pressurizing plate.

In one implementation, the first pressurizing plate may include a first surface that is one surface facing the base plate, a second surface that is the other surface facing the second pressurizing plate, and a mounting corner in a curved shape for connecting the first surface and the second surface to each other, wherein the mounting corner mounts the pants, and the mounting corner may have a curvature of a curved surface connected to the first surface different from a curvature of a curved surface connected to the second surface.

In one implementation, the mounting corner may be connected to the first surface with the curved surface and protrude toward the second pressurizing plate.

In one implementation, the first surface may include a first groove recessed in a longitudinal direction of the door to prevent interference with a seam formed on the pants, and the second surface may include a second groove recessed in the longitudinal direction of the door to prevent the interference with the seam formed on the pants.

In one implementation, the base plate may be spaced apart from the door inner surface by a predetermined separation distance and may be coupled to the door inner surface.

In one implementation, the base plate may include a clip accommodating portion recessed or penetrated into a shape corresponding to a shape of the first clip when the first pressurizing plate pressurizes the base plate.

In one implementation, a width of the second pressurizing plate may be greater than widths of the first pressurizing plate and the base plate.

In one implementation, the laundry treating apparatus may further include a blower disposed inside the second chamber to suck air in the first chamber, a heat pump disposed inside the second chamber to dehumidify and heat the sucked air, a first opening penetrating the first pressurizing plate in a thickness direction, and a second opening penetrating the second pressurizing plate in the thickness direction at a position corresponding to a position of the first opening, and the pants may be exposed to dehumidified and heated air and steam through the first opening and the second opening.

In one implementation, the second pressurizing plate may include protective side surfaces formed by being bent in a direction toward the door inner surface from both side surfaces of the second pressurizing plate, respectively. When the second pressurizing plate pressurizes the first pressurizing plate and the base plate, the protective side surfaces may cover both side surfaces of the base plate and both side surface of the first pressurizing plate.

In one implementation, a cover surface located on a side away from the door inner surface among both surfaces of the second pressurizing plate may further include a handle for a user to hold the second pressurizing plate to pivot the second pressurizing plate.

In one implementation, the laundry treating apparatus may further include an auxiliary shaft vertically connected to the first shaft, and a connecting portion pivotably connected to the auxiliary shaft, and the first pressurizing plate may be not only pivotable around the first shaft, but also pivotable in parallel with the second shaft through the auxiliary shaft.

In one implementation, the laundry treating apparatus may further include a first gear coupled to the connecting portion to pivot together with the connecting portion, and a second gear positioned on one side surface of the second pressurizing plate, and connected to the first gear, wherein the second gear pivots together with the second pressurizing plate, and when the second pressurizing plate pivots around the second shaft, the first pressing plate may be pivotable in parallel with the second shaft by the second gear, the first gear, the connecting portion, and the auxiliary shaft.

In one implementation, the laundry treating apparatus may further include a third gear positioned between the first gear and the second gear for connecting the first gear and the second gear to each other.

In one implementation, the second pressurizing plate may include a pressurizing surface for pressurizing the pants with the first pressurizing plate, and a cover surface located on a side opposite to the pressurizing surface, and when second gear teeth located only on a portion of an outer circumferential surface of the second gear pivot until the second pressurizing plate pivots and the cover surface becomes parallel with the door inner surface, the first pressurizing plate may move from a first position for pressurizing the base plate to a second position to be spaced apart from the base plate by a predetermined separation distance and be in parallel with the base plate.

In one implementation, when the second pressurizing plate pivots in a first pivoting direction, the first gear and the connecting portion may pivot in the first pivoting direction, and the third gear may pivot in a direction opposite to the first pivoting direction.

In one implementation, the base plate may include a gear through-hole penetrating the base plate at a position corresponding to a position of the first gear to prevent interference with the base plate when the first gear pivots.

The present disclosure may reduce the frequency of the unintentional wrinkles or folds occurring as the laundry is pressurized from said one side thereof.

In addition, the present disclosure may uniformly pressurize the laundry to remove the folds or the unintentional wrinkles of the laundry and improve the formation of the predetermined intended creases.

In addition, the present disclosure may pressurize the entire region of the laundry.

In addition, the present disclosure may further facilitate the mounting of the laundry to be pressurized.

DETAILED DESCRIPTION

Hereinafter, a preferred embodiment of the present disclosure will be described in detail with reference to the accompanying drawings. A configuration of an apparatus or a method for controlling the same to be described below is only for describing the embodiment of the present disclosure, not for limiting the scope of the present disclosure, and reference numbers used the same throughout the specification refer to like components.

Specific terms used in the present specification are only for convenience of description and are not used as a limitation of the illustrated embodiment.

For example, expressions such as "same" and "identical" not only indicate the strictly identical state, but also indicate a state in which a tolerance or a difference in the degree of obtaining the same function exists.

For example, expressions such as "in a certain direction", "along a certain direction", "parallel to", "vertically", "central", "concentric", or "coaxial" indicating a relative or absolute arrangement not only strictly indicate such an arrangement, but also indicate a state in which a relative displacement is carried out with a tolerance or an angle or a distance sufficient to obtain the same function.

A term 'wrinkles' used herein without being expressly stated refers to unintentional wrinkles or folds that occur after clothing is worn, or after washing or drying. In other words, the term 'wrinkles' refers to wrinkles that occur unintentionally as the clothing is wrinkled by use or during the washing or the drying, rather than pleats or creases intended for a design or a function from a design step. Therefore, the term 'wrinkles' refers to the folds that need to be removed using a method such as ironing.

Figure 1B:
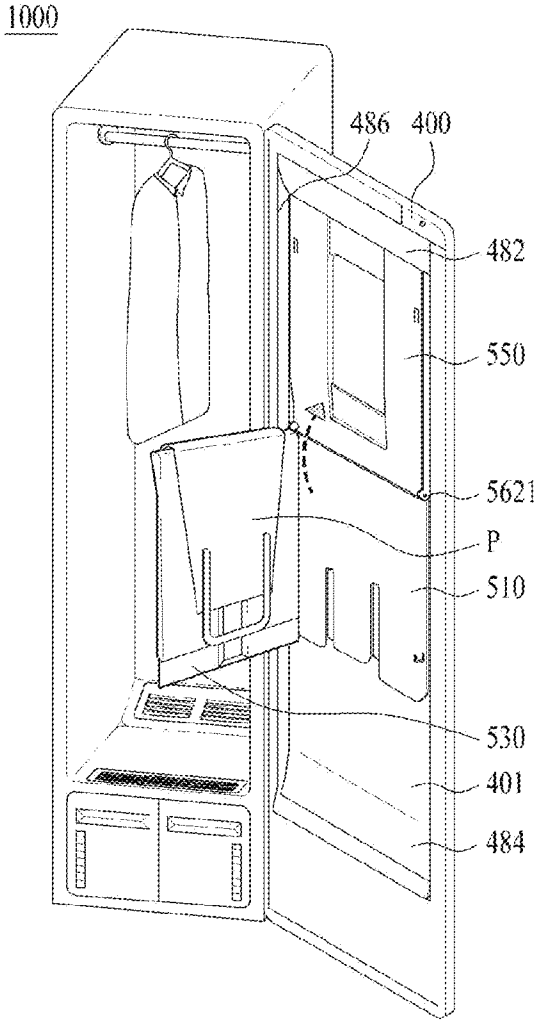
FIG. 1B shows a state in which a second pressurizing plate is opened and a first pressurizing plate is pivoted to mount laundry using a pressurizing portion, which is a feature of the present disclosure.
Figure 1A:
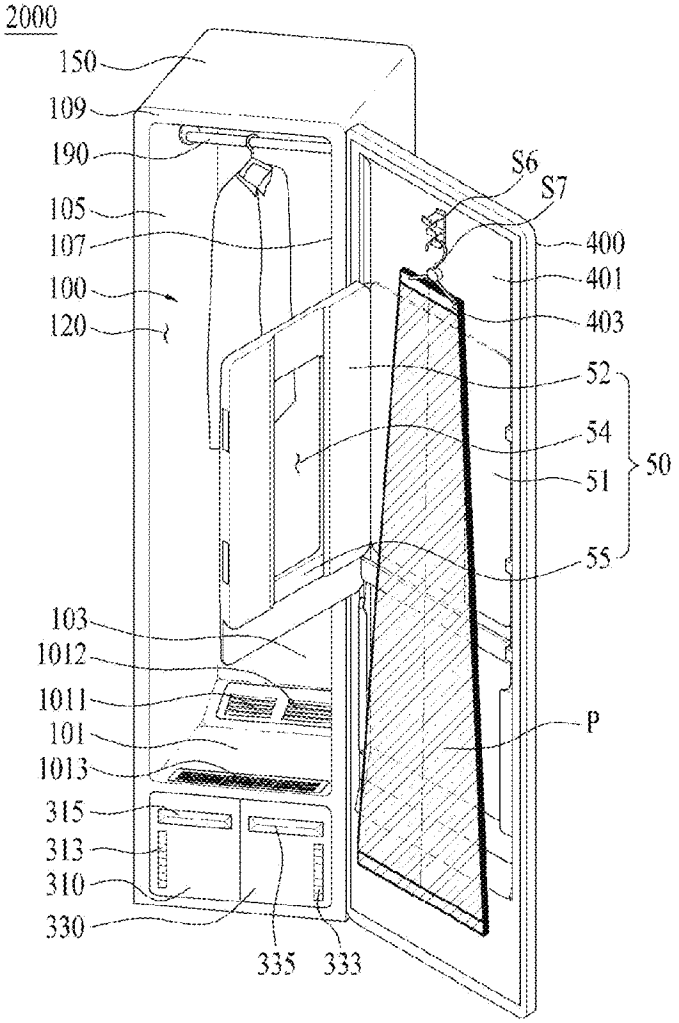
FIG. 1A Prior Art
FIG. 1A shows an example of a conventional laundry treating apparatus and an example of a presser for removing wrinkles of laundry.

FIG. 1A shows an example of a conventional laundry treating apparatus 2000. The laundry treating apparatus 2000 includes a cabinet 150 including a laundry inlet 120 defined in one surface thereof, a first chamber 100 positioned inside the cabinet 150 and accommodating laundry through the laundry inlet 120, a second chamber 200 positioned underneath the first chamber 100 and defining a space therein separated from a space defined in the first chamber 100, a steamer 250 (see FIG. 2) that is disposed in the second chamber 200, generates steam, and supplies the steam to the first chamber 100, and a door 400 that is pivotably coupled to the cabinet 150 to open and close the laundry inlet 120. Considering usage methods of general users, preferably, the laundry inlet 120 will be defined in a front surface of the cabinet 150.

In addition, the laundry treating apparatus 2000 may further include a blower 220 (see FIG. 2) located inside the second chamber 200 and sucking air of the first chamber 100, and a heat pump unit 230 that dehumidifies and heats the sucked air and then discharges the air to the first chamber 100.

The cabinet 150 may be made of a metal material, and may be made of a plastic material when strength thereof is able to be maintained. In addition, the first chamber 100 may be formed by plastic injection molding. The first chamber 100 may be coupled to the cabinet 150 by a frame (not shown). Alternatively, a space between the cabinet 150 and the first chamber 100 may be filled with a foamed plastic such as polyurethane.

The laundry including tops and bottoms may be placed in the first chamber 100, and the laundry may be managed to be refreshed through the blower 220 (see FIG. 2), the heat pump 230 (see FIG. 2), and the steamer 250 (see FIG. 2) located inside the second chamber 200. That is, a function of sterilizing and deodorizing the laundry using the steam and/or heated air, and removing the folds formed by use may be performed through the blower 220 (see FIG. 2), the heat pump 230 (see FIG. 2), and the steamer 250 (see FIG. 2) located inside the second chamber 200.

The first chamber 100 may include a laundry support 190 for mounting the laundry at an upper portion of an interior of the first chamber 100. The laundry support 190 may accommodate a hanger on which the laundry is hung, and may be connected to a driver (not shown) capable of reciprocating the laundry support 190 in a left and right direction. The movement of the laundry support 190 may shake the laundry, and eventually foreign matters including fine dust attached to the laundry may be separated. In addition, while shaking the laundry mounted on the laundry support 190, the wrinkles of the laundry may be removed to some extent by being exposed to the steam or moisture supplied from the second chamber 200.

That is, the laundry support 190 allows the laundry to be mounted in an unfolded state by a self load thereof at the interior of the first chamber 100, thereby allowing the laundry to be uniformly exposed to the dehumidified and heated air and/or steam supplied from the second chamber 200.

In general, water boils at 100° C. under atmospheric pressure. In this connection, generated water vapor may be referred to as the steam. Moisture, on the other hand, refers to a form in which water droplets of 1 mm or less are suspended in the air at room temperature. For example, the moisture is like fog. In general, because the steam generated by boiling water has a greater sterilization power than the moisture because of a higher temperature, and water molecules move more actively at high temperature, permeability of the laundry is excellent for the case of the steam, so that the steam may be utilized more than the moisture to refresh the laundry.

The first chamber 100 is formed by a first chamber top surface 109 on which the driver (not shown) of the laundry support 190 is located, a first chamber bottom surface 101 that forms a bottom of the first chamber 100, first chamber left and right side surfaces 105 and 107 that connect the first chamber top surface 109 and the first chamber bottom surface 101 to each other, and a first chamber rear surface 103. When said one surface in which the laundry inlet 120 is defined is the front surface, the rear surface of the first chamber 103 will be located on a side opposite to the front surface.

An air supply port 1011 and a steam supply port 1012 for supplying the steam generated by the steamer 250 and the air dehumidified and heated by the heat pump 230 in the second chamber 200 to the first chamber, and an air suction port 1013 for sucking the air of the first chamber 100 by the blower 220 may be located on the first chamber bottom surface 101.

As shown in FIG. 1A, the air supply port 1011 and the steam supply port 1012 may be disposed in a region where the first chamber bottom surface 101 and the first chamber rear surface 103 meet. In addition, the region where the first chamber bottom surface 101 and the first chamber rear surface 103 meet may have a smoothly inclined shape. The air suction port 1013 may be located on the first chamber bottom surface 101 close to the laundry inlet 120. Accordingly, the air inside the first chamber 100 will be discharged through the air supply port 1011 and then sucked through the air suction port 1013 to circulate. The steam will also be discharged through the steam supply port 1012, then condensed, then sucked through the air suction port 1013, and then collected in a sump (not shown) for storing condensate therein.

In order to more smoothly discharge the condensate condensed inside the first chamber 100 into the second chamber 200 through the air suction port 1013, the first chamber bottom surface 101 may be inclined downward in a direction of the laundry inlet 120 from the first chamber rear surface 103.

As shown in FIG. 1A, the laundry treating apparatus 2000 may include a water supply tank 310 for supplying water to the steamer 250 and a drain tank 330 for discharging and storing the condensate collected in the sump (not shown) at a front portion of the second chamber 200. In addition, a tank module frame (not shown) for defining a tank installation space (not shown) in which the water supply tank 310 and the drain tank 330 are installed may be disposed to separate the tank installation space (not shown) and the second chamber 200 from each other. That is, the tank installation space 351 and the second chamber 200 may be located underneath the first chamber 100, and the tank installation space may be located close to the door 400 and the second chamber 200 may be located at the rear of the tank installation space.

Each of the water supply tank 310 and the drain tank 330 may be constructed to be detachable from the tank module frame (not shown). However, alternatively, the water supply tank 310 and the drain tank 330 may be coupled to each other to be attached or detached at the same time.

The door 400 may include a rear surface of the door 400 or a door inner surface 401 directed in a direction from the door 400 to the first chamber 100 when the door 400 is closed. The door 400 will be pivotably connected to the cabinet 150 in a hinge scheme to open and close the laundry inlet 120.

When a user closes the door 400, a front surface of the water supply tank 310 and a front surface of the drain tank 330 may face the door inner surface 401. When the user opens the door 400, the front surface of the water supply tank 310 and the front surface of the drain tank 330 may be exposed to the outside. In addition, the water supply tank 310 and the drain tank 330 include a water supply tank window 313 and a drain tank window 333 on the front surfaces thereof, respectively, so that water levels of the water stored inside the water supply tank 310 and the drain tank 330 may be identified immediately.

A water supply tank handle 315 and a drain tank handle 335 may be disposed on the front surface of the water supply tank 310 and the front surface of the drain tank 330, respectively. When the user pulls each of the water supply tank handle 315 and the drain tank handle 335, each of the water supply tank 310 and the drain tank 330 may be separated from the tank module frame (not shown) by pivoting about each of a distal end of the front surface of the water supply tank and a distal end of the front surface of the drain tank. In addition, when mounting the water supply tank 310 and the drain tank 330 on the tank module frame (not shown), the water supply tank 310 and the drain tank 330 will be seated on the tank module frame (not shown) through the pivoting as well.

In the case of the conventional laundry treating apparatus 2000, a laundry fixing portion 405 for hanging a laundry hanger 403 after mounting pants P upside down on the laundry hanger 403, and a presser 50 for pressurizing the pants fixed by the hanger 403 may be located on the door inner surface 401 or inside the first chamber 100.

The reason for hanging the pants P upside down, that is, with a bottom hem up, is to allow the pants P to be evenly unfolded as a tensile force is applied thereto through a self load of the pants P because a weight of an upper end, that is, a pant waist of the pants P is greater than a weight of a lower end, that is, pant legs of the pants P.

The presser 50 may include a support plate 51 coupled to the door inner surface 401 and supporting the laundry, and a pivoting plate 52 pivoting toward the support plate 51 to pressurize the pants P. When the pivoting plate 52 pivots toward and is coupled to the support plate 51, the pivoting plate 52 becomes able to pressurize the pants P. Thereafter, as the door 400 is closed, the fold may be removed by being exposed to the steam and the dehumidified and heated air inside the first chamber 100. In this connection, the presser 50 may include a pivoting plate through-hole 54 penetrating the pivoting plate 52 to facilitate penetration of the steam into the pants P, and may further include a depression 55 defined in a surface in contact with the pants P of both surfaces of the pivoting plate in order to prevent a scam formed along a longitudinal direction of the pant legs of the pants P from being pressurized.

Figure 2:
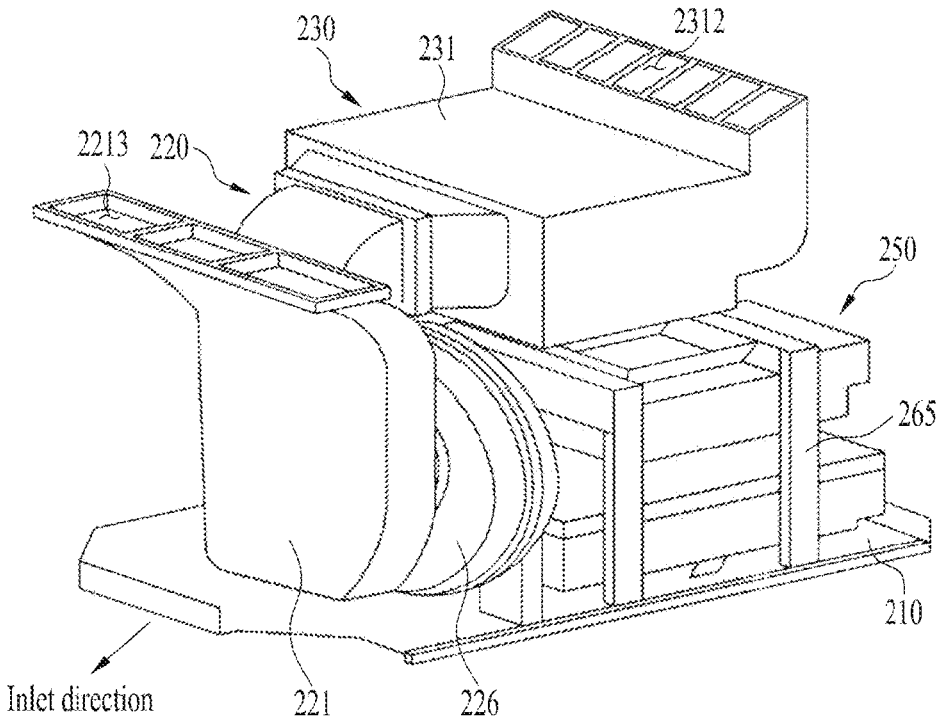
FIG. 2 shows an example of a blower, a heat pump, and a steamer mounted inside a second chamber.

Referring to FIG. 2, the blower 220 for sucking the air of the first chamber 100, the steamer 250 for receiving water from the water supply tank 310, generating the steam, and then, supplying the steam to the first chamber 100, and the heat pump 230 for dehumidifying and heating the air sucked by the blower 220 and discharging the air to the first chamber 100 may be included inside the second chamber 200. In addition, a controller (not shown) for controlling the blower 220, the steamer 250, and the heat pump 230 may be located.

Therefore, in order to supply the dehumidified and heated air to the first chamber 100, the air inside the first chamber 100 is sucked through an inlet duct 221 after generating a suction force using a blower fan 226. Then, the air is flowed to the heat pump 230, then is subjected to heat exchange, and then, is supplied to the first chamber 100 again.

Referring to FIG. 2, the blower 220 may include the blower fan 226 and the inlet duct 221. When a side on which the laundry inlet 120 is located is referred to as a front side, and a side on which the rear surface of the first chamber is located is referred to as a rear side, the inlet duct 221 may be disposed in front of the blower fan 226, and the tank module frame (not shown) may be disposed in front of the inlet duct 221. Accordingly, the tank module frame may separate the tank installation space 351 and the second chamber 200 from each other.

The water supply tank 310 and the drain tank 330 seated on the tank module frame may be located closer to one of both side surfaces of the cabinet 150. For example, in the tank installation space (not shown), a right side surface of the cabinet 150 may be located closer to the water supply tank 310 than a left side surface of the cabinet. Conversely, the left side surface of the cabinet 150 may be located closer to the drain tank 330 than the right side surface of the cabinet.

Inside the second chamber 200, the right side surface of the cabinet 150 may also be located closer to the steamer 250 than the left side surface of the cabinet 150 in the same manner as the location of the water supply tank 310. This is to simplify a connection flow channel through which water flows from the water supply tank 310 to the steamer 250 by disposing the steamer 250 at the rear of the water supply tank 310.

The steamer 250 may heat water located inside the steamer 250 using a heater, and the generated steam may be in communication with the steam supply port 1012 disposed on the first chamber bottom surface 101 along a steam flow channel (not shown).

When the water supply tank 310 is located closer to the left side surface of the cabinet 150 than to the right side surface of the cabinet 150, the steamer may also correspondingly be located closer to the left side surface of the cabinet 150 than to the right side surface of the cabinet 150.

In addition, the inlet duct 221 may include an inlet duct entrance 2213 that communicates with the air suction port 1013 disposed on the first chamber bottom surface 101 and sucks the air of the first chamber 100. In addition, the inlet duct entrance 2213 may define an inclined flow channel therein. This is to easily flow the condensate generated in the first chamber 100 and on the door 400 to a sump (not shown) disposed inside of and in a lower portion of the inlet duct 221 along the inclined flow channel after passing through the inlet duct entrance 2213 in communication with the first chamber bottom surface 101.

The inlet duct 221 may be positioned in front of the blower fan 226, and the steamer 250 and the heat pump 230 may be disposed at the rear of the blower fan 226. In addition, the heat pump 230 may be supported by a supporter 265. The supporter 265 may be disposed on a base 210 forming a bottom of the second chamber 200. Therefore, the supporter 265 may form a predetermined separation distance between the base 210 and the heat pump 230, and define a predetermined installation space between the supporter 265 and the base portion 210. The steamer 250 may be located in the installation space, and may be coupled to the supporter 265 in the installation space. FIG. 2 shows an example in which the controller 270 is positioned underneath the steamer 250 in the installation space of the supporter 265, but the controller 270 is able to be installed anywhere inside the second chamber 200 such as a location at the rear of the steamer 250.

The heat pump 230 may further include a housing 231 having a first heat exchanger (or an evaporator) (not shown) and a second heat exchanger (or a condenser) (not shown) therein, and an air outlet 2312 in communication with the air supply port 1011 disposed in the first chamber 100 to discharge the dehumidified and heated air from the housing 231 to the first chamber 100. A compressor (not shown) and an expansion valve (not shown) for circulating a refrigerant may be located outward of the supporter 265.

Unlike as shown in FIG. 2, the blower may circulate the air of the first chamber, and the evaporator and the condenser may be disposed inside a duct for flowing the air circulated by the blower. That is, the blower may be composed of the inlet duct 221, the blower fan 226, a connection duct (corresponding to the housing in FIG. 2) and an exhaust duct (corresponding to the air outlet in FIG. 2), and the heat pump may include the evaporator and the condenser disposed inside the connection duct, and the compressor and an expansion portion disposed outside the blower.

Referring to FIG. 1B, the door 400 may include the door inner surface 401 directed in the direction from the door 400 to the first chamber 100, a door gasket 486 disposed on the door inner surface 401 and in close contact with an edge of the cabinet 150 to form a sealing between the door 400 and the cabinet 150, and door liners 482 and 484 disposed on the door inner surface 401 to guide the condensate generated in the first chamber 100 to the first chamber bottom surface 101 when the door 400 is closed. In some embodiments, the door 400 has a structure that may open and close the first chamber 100 and the tank installation space 351 at the same time. In another embodiment, a plurality of doors may be installed in the cabinet 150, and independently open and close the first chamber 100 and the tank installation space 351, respectively. The door liners 482 and 484 may be constructed to face the first chamber 100 when the door 400 is closed, and may include an upper door liner 482 and a lower door liner 484. The door liners 482 and 484 may discharge the condensate generated on surfaces of the door liners 482 and 484 to the sump (not shown) disposed in the lower portion of the inlet duct through the air suction port 1013 disposed on the first chamber bottom surface 101.

The door gasket 486 may be mounted on the door inner surface 401 to surround the door inner surface 401. The sealing between the door 400 and the cabinet 150 may be achieved by the door gasket 486. In addition, the door gasket 486 may individually seal the first chamber 100 and the tank installation space 351.

In addition, FIG. 1B shows a laundry treating apparatus 1000, which is an embodiment of the present disclosure, and shows an example of a pressurizing portion 500 different from the presser 50 constructed in the conventional laundry treating apparatus 2000 to remove the wrinkles of the pants.

That is, the laundry treating apparatus 1000 may include the cabinet 150 including the laundry inlet 120 defined in one surface thereof, the first chamber 100 positioned inside the cabinet 150 to accommodate the laundry through the laundry inlet 120, the second chamber 200 positioned underneath the first chamber 100 to define the space separated from the space of the first chamber 100, the steamer 250 (see FIG. 2) disposed inside the second chamber 200 to generate the steam and supply the steam to the first chamber, the door 400 pivotably coupled to the cabinet 150 to open and close the laundry inlet 120, the door inner surface 401 directed in the direction toward the first chamber 100 among both surfaces of the door, a base plate 510 coupled to the door inner surface 401, a first shaft 5611 (see FIGS. 6A and 6B) disposed parallel to a height direction of the door 400, a second shaft 5621 disposed perpendicular to the height direction of the door 400, a first pressurizing plate 530 pivotably coupled to the door inner surface 401 or the base plate 510 through the first shaft 5611 (see FIGS. 6A and 6B) to face the base plate 510, and mounting and pressurizing the pants, and a second pressurizing plate 550 pivotably coupled to the door inner surface 401 or the base plate 510 through the second shaft 5621 to face the first pressurizing plate 530, and pressurizing the pants.

The second pressurizing plate 550 may be coupled to the base plate 510 and/or the first pressurizing plate 530 to pressurize the base plate 510 and/or the first pressurizing plate 530, but may be simply coupled to the base plate 510 and/or the first pressurizing plate 530 to protect the pants mounted on the first pressurizing plate 530, or to perform only a cover role for protecting the base plate 510 and/or the first pressurizing plate 530.

In particular, the pressurizing portion 500 includes the base plate 510 coupled to the door inner surface 401, the first shaft 5611 (see FIGS. 6A and 6B) disposed parallel to the height direction of the door 400, the second shaft 5621 disposed perpendicular to the height direction of the door 400, the first pressurizing plate 530 pivotably coupled to the door inner surface 401 or the base plate 510 through the first shaft 5611 (see FIGS. 6A and 6B) to face the base plate 510, and mounting and pressurizing the pants, and the second pressurizing plate 550 pivotably coupled to the door inner surface 401 or the base plate 510 through the second shaft 5621 to face the first pressurizing plate 530, and pressurizing the pants.

Roughly, the pressurizing portion 500 may include the second pressurizing plate 550 that may pivot in a vertical direction of the door 400, the first pressurizing plate 530 that may pivot in a left and right direction of the door 400, and the base plate 510 coupled to the door inner surface. The first pressurizing plate 530 and the second pressurizing plate 550 may pivot around the first shaft 5611 (see FIGS. 6A and 6B) constructed along the height direction of the door, and the second shaft 5621 constructed perpendicular to the first shaft 5611 (see FIGS. 6A and 6B), respectively.

When the second pressurizing plate 550 pivots along a width direction of the door 400—pivots around an axial direction of the second shaft—, the first pressurizing plate 530 capable of mounting and fixing the pants may be exposed. In this connection, the first pressurizing plate 530 may be pivoted by the first shaft 5611 (see FIGS. 6A and 6B) while maintaining a vertical level thereof constant. That is, the first pressurizing plate 530 may pivot in the left and right direction around the first shaft like the door 400.

FIG. 1A shows an example in which the first pressurizing plate 530 pivots around the first shaft 5611 disposed on a left side surface of the first pressurizing plate 530, and the second pressurizing plate 550 pivots around the second shaft 5621 disposed above the second pressurizing plate 550, but the first shaft 5611 may be disposed on a right side surface of the first pressurizing plate 530, and the second shaft 5621 may be disposed below the second pressurizing plate 550. That is, when the first pressurizing plate 530 and the second pressurizing plate 550 pivot around axial directions thereof by the first shaft 5611 and the second shaft 5621, the location of the second shaft 5621 and which side surface the first shaft 5611 is located on may not be important.

That is, depending on whether the user is left-handed or right-handed, the first pressurizing plate 530 and the second pressurizing plate 550 may pivot in opposite directions by placing the first shaft and the second shaft of the pressurizing portion on opposite sides. This characteristic is called reversible.

Figure 3A:
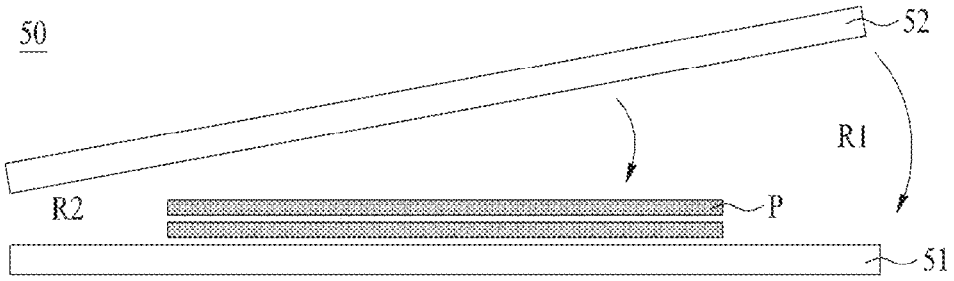
FIGS. 3A and 3B schematically show a problem that occurs as pants are pressurized starting from one side thereof in a conventional laundry treating apparatus.
Figure 3B:
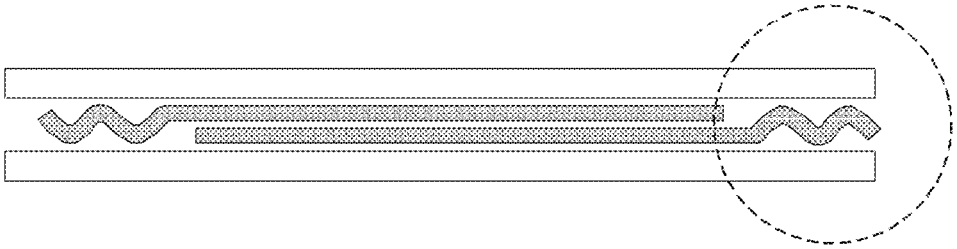

FIGS. 3A and 3B schematically shows the presser 50 of the conventional laundry treating apparatus 2000. In particular, FIG. 3A shows a state in which the pivoting plate 52 pivots toward the support plate 51 on which the pants P are mounted, and FIG. 3B schematically shows a state in which the pivoting plate 52 is pivoted and coupled to the support plate 51 to pressurize the pants P located between the pivoting plate 52 and the support plate 51.

The pivoting plate 52 pivots through a pivoting coupling portion (not shown), for example, a hinge, disposed on one of both side surfaces of the pivoting plate 52 to pressurize the pants P. In this connection, the pants P will be pressurized from one side surface where the pivoting coupling portion is located. That is, the pants P are pressurized from a region R2 close to the pivoting coupling portion. When the pivoting plate 52 is completely pivoted to face the support plate 51, that is, when the other side surface of the pivoting plate 52 is coupled to the support plate 51, the pants P will be pressurized up to a region R1.

Therefore, while the pivoting plate 52 pivots, a uniform pressure is not applied to the pants P. In this case, a relatively large pressure is applied to a portion (the region R1) of the pants P close to the pivoting coupling portion, and a relatively small pressure is applied to a portion (the region R2) far from the pivoting coupling portion, so that the pants P may not be evenly pressurized.

Further, in the process of the pants P being pressurized by the pivoting plate 52, the pants may be pushed by the pivoting plate 52, which may cause a problem that a fixed shape of the laundry is changed or a position of the laundry is changed. Therefore, in the conventional laundry treating apparatus 2000, as indicated by a dotted circle in FIG. 3B, more wrinkles of the laundry may occur or wrinkles in directions completely different from the intended direction may occur. FIG. 3B is exaggerated to emphasize such a case.

In addition, even when the pants P are mounted, the pants P are simply hung on a laundry mounting portion 56 (see FIG. 1A), but are not able to be fixed, so that the position of the laundry is not able to be prevented from changing during pressurization.

In addition, when the pants P are mounted on the inner surface of the door with a total length of the pants without being folded, because a vertical level of the laundry mounting portion 56 (see FIG. 1A) is high, there may be an inconvenience for the user. In addition, because the laundry mounting portion 56 occupies most of the door inner surface 401, there is a problem in that usability of the door inner surface 401 may be deteriorated.

The present disclosure relates to an example of the laundry treating apparatus 1000 including the pressurizing portion 500 shown in FIG. 1B to solve the above-described problems. Because the pressurizing portion 500 may fold the pants through the first pressurizing plate 530, the space occupied by the pressurizing portion 500 or the pants P on the door inner surface 401 may be reduced by about half.

In one example, the pants P may be fixed through a clip or the like disposed on the first pressurizing plate 530. In addition, even when the first pressurizing plate pivots completely along the height direction of the door, that is, around the first shaft, like the pivoting direction of the door 400, the first pressurizing plate 530 does not immediately pressurize the pants P by being coupled to the base plate 510, and the first pressurizing plate 530 and the base plate 510 are able to be disposed to face away from each other by a predetermined separation distance. Thereafter, when the second pressurizing plate 550 is pivoted along the width direction of the door, that is, around the second shaft 5621, and coupled to the first pressurizing plate 530 and the base plate 510, the first pressurizing plate may be coupled to the base plate 510. In this case, the base plate 510 and the first pressurizing plate 530 face each other in parallel with each other, and the first pressurizing plate 530 approaches the base plate 510, so that an entire region of the pants P will be pressurized uniformly at the same time. This will be described later in detail with reference to FIGS. 4A to 8D.

FIGS. 4A to 4E sequentially shows a method of using the pressurizing portion 500 disposed on the door 400 to remove the wrinkles of the pants P. The pressurizing portion 500 may be disposed on the door inner surface 401 or the first chamber side surface 105, but FIGS. 4A to 4E shows an example in which the pressurizing portion 500 is disposed on the door inner surface 401.

Figures 4A, 4B, 4C, 4D, 4E:
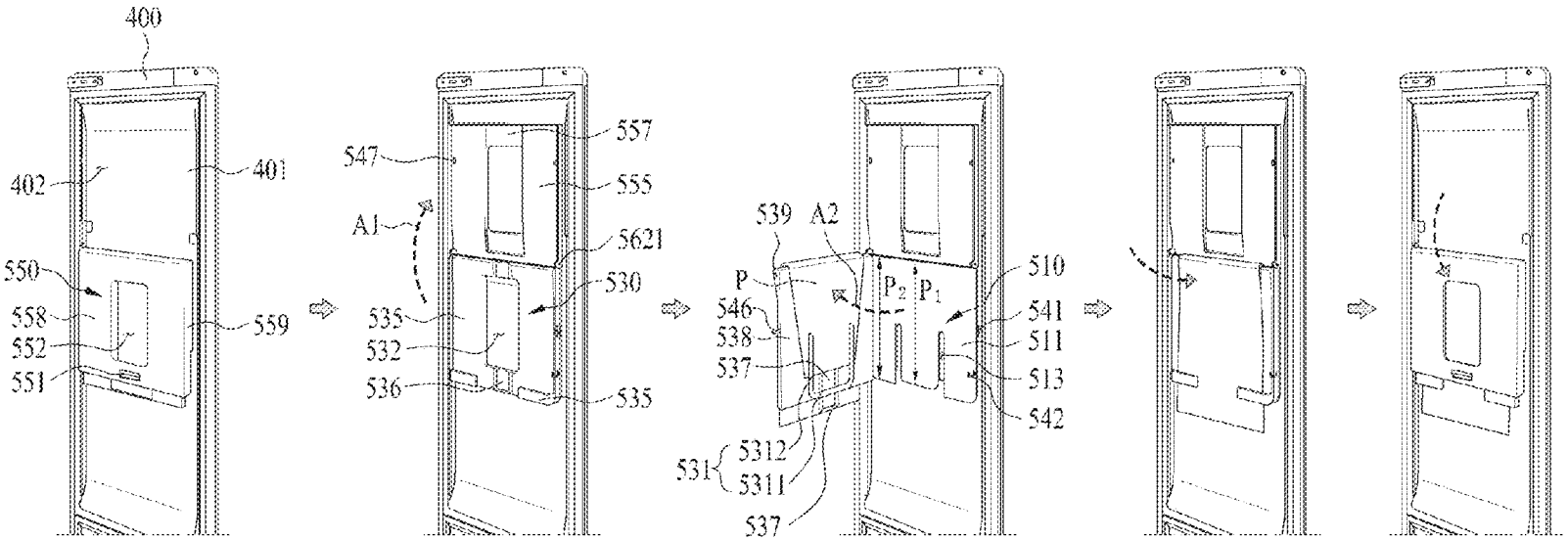
FIGS. 4A to 4E list a method for using a pressurizing portion, which is an embodiment of the present disclosure, in order.

Referring to FIG. 4C, the pressurizing portion 500 includes the base plate 510 coupled to the door inner surface 401, the first shaft 5611 (see FIGS. 6A and 6B) disposed parallel to the height direction of the door 400, the second shaft 5621 disposed perpendicular to the height direction of the door 400, the first pressurizing plate 530 pivotably coupled to the door inner surface 401 or the base plate 510 through the first shaft 5611 (see FIGS. 6A and 6B) to face the base plate 510, and mounting and pressurizing the pants, and the second pressurizing plate 550 pivotably coupled to the door inner surface 401 or the base plate 510 through the second shaft 5621 to face the first pressurizing plate 530, and pressurizing the pants.

Considering only the pressurizing portion 500, the pressurizing portion 500 may include the second pressurizing plate 550 that may pivot in the vertical direction on the door inner surface 401, the first pressurizing plate 530 that may pivot in the left and right direction on the door inner surface 401, and the base plate 510 coupled to the door inner surface. The first pressurizing plate 530 and the second pressurizing plate 550 may pivot around the first shaft 5611 (see FIGS. 6A and 6B) constructed along the height direction of the door, and the second shaft 5621 constructed perpendicular to the first shaft 5611 (see FIGS. 6A and 6B), respectively.

In this specification, pivoting in the vertical direction of the door 400 means pivoting around the shaft formed parallel to the width direction of the door 400, and pivoting in the left and right direction of the door 400 means pivoting around the shaft formed parallel to the height direction of the door 400. The height direction of the door 400 and the width direction of the door 400 are perpendicular to each other. Accordingly, the first shaft 5611 (see FIGS. 6A and 6B) and the second shaft 5621 are perpendicular to each other, and the first shaft 5611 and an auxiliary shaft 5612 (see FIGS. 6A and 6B) connected to the first shaft are also perpendicular to each other. Accordingly, the second shaft 5621 and the auxiliary shaft 5612 (see FIGS. 6A and 6B) are parallel to each other.

In addition, in this specification, penetrating in the thickness direction means penetrating a top surface and a bottom surface, which are formed by horizontal sides and vertical sides of a member having a very large height (or thickness) like a plate-shaped member, in a direction from the top surface to the bottom surface or from the bottom surface to the top surface direction.

Referring to FIGS. 4A and 4B, when the door 400 is opened, the second pressurizing plate 550 of the pressurizing portion 500 may be exposed to the outside. Accordingly, the second pressurizing plate 550 may function as a cover for protecting the base plate 510 and the first pressurizing plate 530. In addition, the second pressurizing plate 550 may also perform a function of pressurizing a portion including the pant waist when the pants P are mounted as shown in FIG. 4C. The second pressurizing plate 550 may include a pressurizing surface 555 facing the pants and a cover surface 558 located on an opposite side of the pressurizing surface. The second pressurizing plate 550 may further include a second opening 552 defined therein that penetrates the second pressurizing plate 550 in a thickness direction of the second pressurizing plate 550, that is, in a direction from the pressurizing surface 555 to the cover surface 558. The second opening 552 may facilitate the penetration of the steam into the pants P mounted in the pressurizing portion 500 together with a first opening 532, which will be described later, penetrating the first pressurizing plate 530 to improve a moisture content of the laundry.

In addition, the cover surface 558 may include a handle 551 with which the user may hold the second pressurizing plate 550 in order to pivot the second pressurizing plate 550 in the vertical direction. Preferably, the handle 551 may be located below the cover surface 558. The handle 551 may be a simple handle, or may also perform a function of releasing lock between a locking hook 542 and a locking hole 547 to be described later. That is, when the handle 551 is pulled, coupling between a catch portion (not shown) located inside the lock hole 547 and the locking hook 542 may be released.

In addition, the second pressurizing plate 550 may protect side surfaces of the base plate 510 and the first pressurizing plate 530 in order to perform the cover function to protect the first pressurizing plate 530 and the base plate 510. In this case, the second pressurizing plate 550 may further include protective side surfaces 559 formed by being bent in a direction toward the door inner surface 401 from both side surfaces of the second pressurizing plate 550, respectively. To this end, a width of the second pressurizing plate 550 will be greater than a width of each of the first pressurizing plate 530 and the base plate 510.

On the door inner surface 401, the second pressurizing plate 550 may pivot A1 in the vertical direction of the door around the second shaft 5621 formed in parallel along the width direction of the door 400. In one example, the second pressurizing plate 550 may also pivot in an opposite direction as shown by an arrow FIG. 4E.

The door inner surface 401 may be recessed inwardly of the door by a length corresponding to the thickness of the second pressurizing plate 550 to define therein a recessed space 402 for accommodating the second pressurizing plate 550 therein to minimize protrusion of the second pressurizing plate 550 from the door inner surface 401 when the second pressurizing plate 550 is pivoted along the width direction of the door and turned upward, that is, when the cover surface 558 faces the door inner surface 401.

FIG. 4A shows that the user opens the door 400 and the pressurizing portion 500 is exposed, and FIG. 4B shows a state in which the second pressurizing plate 550 is pivoted around the second shaft 5621 disposed along the width direction of the door 400 and accommodated in the recessed space 402 in order for the user to mount the pants P. In addition, the pressurizing surface 555 may include a prevention groove 557 in a recessed form for preventing a sewing line of the pants P from being pressurized. The prevention groove 557 is defined in a longitudinal direction of the pressurizing surface 555, which is for preventing the sewing line (or the seam) generated during sewing of a front panel and a back panel of the pants from being pressurized when the second pressurizing plate 550 is closed. This is because, unnecessary folds may occur around the sewing line when the sewing line is pressurized because the sewing line generally protrudes than fabric of the pants.

Referring to FIGS. 4B and 4C, the first pressurizing plate 530 may be positioned between the base plate 510 and the second pressurizing plate 550. The first pressurizing plate 530 may include a first surface 535 facing the second pressurizing plate, a second surface 538 facing the base plate 510, and the first shaft 5611 disposed along the height direction of the door 400 to pivot the first pressurizing plate 530 in the left and right direction. The first shaft 5611 may pivotably couple the first pressurizing plate 530 to the door inner surface 401 or the base plate 510. The first pressurizing plate 530 may pivot A2 in the left and right directions by the first shaft 5611.

In one example, the first pressurizing plate 530 may include a first clip 531 and a second clip 533 to fix the pants P mounted on the first pressurizing plate 530. The first clip 531 may be positioned at a lower portion of the second surface 538, and the second clip 533 may be positioned at a lower portion of the first surface 535. The first clip 531 may fix a portion of the pants including a hem of the pants. Referring to FIG. 4D, the second clip 533 may fix both sides of an opposite portion of the hem of the pants, that is, the pant waist and both sides of the pant legs connected to the pant waist.

The first pressurizing plate 530 may further include a mounting corner 539, which is a corner on which the pants P are mounted on an upper end thereof. The mounting corner 539 has a curved surface, so that the unnecessary wrinkles or folds may be prevented from being generated even when the pants P are mounted.

In addition, the mounting corner 539 may include a first curved surface 5391 (see FIG. 5B) connected to the first surface 535, and a second curved surface 5392 (see FIG. 5B) connecting the first curved surface to the second surface 538. The first curved surface 5391 (see FIG. 5B) and the second curved surface 5392 (see FIG. 5B) may have different curvatures and thus may have asymmetrical shapes. That is, the first curved surface 5391 (see FIG. 5B) may have a shape that protrudes in a direction away from the door inner surface 401 than the first surface 535. Accordingly, a radius of curvature of the first curved surface 5391 (see FIG. 5B) may be greater than that of the second curved surface 5392 (see FIG. 5B).

The first pressurizing plate 530 may further include the first opening 532 penetrating the first pressurizing plate 530 in the thickness direction of the first pressurizing plate 530. The first opening 532 may be positioned in the first pressurizing plate 530 to correspond to a position of the second opening 552 defined in the second pressurizing plate 550. This is to facilitate the penetration of the steam into the pants P through the second opening 552 when closing the second pressurizing plate 550, that is, when the second pressurizing plate 550 pivots around the second shaft and the pressurizing surface 555 of the second pressurizing plate 550 is at a position facing the first pressurizing plate 530 and the pants P.

In addition, both surfaces of the first pressurizing plate 530, that is, the first surface 535 and the second surface 538 may respectively include a first groove 536 and a second groove 537 recessed along the longitudinal direction of the first pressurizing plate 530 to prevent the sewing line of the pants P from being pressurized during the pressurization.

In one example, the first pressurizing plate 530 may include the first clip 531 and the second clip 533 for fixing the mounted pants P. The first clip 531 may be disposed on the second surface 538 and may have a U-shape. As long as no external force acts on the first clip 531, the first clip 531 may be a biased member in which a force acts only in a direction of pressurizing the laundry inserted into the clip toward the first pressurizing plate 530. For example, the first clip 531 may be the biased member made of an elastic member and using an elastic force.

The first clip 531 may include a clip fixing portion 5311 for fixedly coupling the first clip 531 to the first pressurizing plate 530, and a clip support 5312 that is bent and extended from both ends of the clip fixing portion. When the pants P are inserted into the clip support 5312, the clastic force acts toward the first pressurizing plate 530 to fix the pants P.

The second clip 533 may be located at the lower portion of the first surface 535 facing the second pressurizing plate 550 to not allow the opposite portion of the pants fixed by the first clip 531 to move. Preferably, the first clip 531 may fix the hem of the pant legs, and the second clip 533 may fix both side surfaces of the pant waist, which are the portion opposite to the hem. The second clip 533 may be formed as a clip having an angled shape, like an angled bracket. The second clip 533 may also be made of an elastic member, and fix the pants like a clamp. However, the second clip 533 may be preferably formed as a pair of angled clips respectively connected in directions of both side surfaces from the lower portion of the first surface 535. Accordingly, the second clip 533 in the angled shape may define a predetermined gap 5331 between the second clip 533 and the first surface 535. The predetermined gap 5331 may always maintained, and both side surfaces of the pants are respectively inserted into the predetermined gaps 5331 to fix the pants.

For the second clip 533 for fixing the pants using the predetermined gap 5331, a physical force, such as the elastic force may not act as in the first clip 531. This takes into account that lengths of the pants P mounted on the first pressurizing plate 530 are different. That is, a length of pants for adults and a length of pants for children may be different from each other. In this connection, when the positions of the first clip 531 and the second clip 533 are fixed based on the length of the pants for the adults, there may be a problem in that the pants for the children are not able to be fixed. Therefore, when the first clip 531 is fixed, the position of the second clip 533 should be variable. However, because changing the position of the second clip 533 requires another component, a thickness of the first pressurizing plate 530 increases and the apparatus becomes complicated. To solve this simply, the second clip 533 may insert both side surfaces of the pants P therein and fix both side surface of the pants P at both side surfaces of the first pressurizing plate 530, rather than fixing the ends of the pants P being mounted.

The second pressurizing plate 550 may be coupled to the door inner surface 401 or the base plate 510. FIGS. 4A to 4E show an example in which the second pressurizing plate 550 is coupled to the base plate 510. In addition, the first pressurizing plate 530 may also be coupled to the door inner surface 401 or the base plate 510, but FIGS. 4A to 4E show that the second pressurizing plate 550 is coupled to the base plate 510 as an example.

The first pressurizing plate 530 may include a locking pin 546 coupled to a distal side-edge located on an opposite side of an edge (a proximal side-edge) where the first shaft 5611 is located in a direction perpendicular to the first shaft or the width direction of the door. In addition, the base plate 510 includes a locking pin coupling portion 541 disposed at a corresponding position for coupling with the locking pin 546.

Therefore, when the first pressurizing plate 530 pivots around the first shaft 5611 and approaches the base plate 510, the first pressurizing plate 530 and the base plate 510 may be coupled to each other as the locking pin 546 and the locking pin coupling portion 541 are fastened to each other. The locking pin coupling portion 541 may be made of an elastic member. Therefore, when the locking pin 546 is accommodated in the locking pin coupling portion 541, because a diameter of the locking pin 546 is smaller than that of an entrance of an accommodating portion of the locking pin coupling portion 541, a slight external force should be applied for the locking pin 546 to enter the locking pin coupling portion 541 and be coupled thereto. A locking device between the first pressurizing plate 530 and the base plate 510 may be constructed differently. That is, the base plate 510 and the first pressurizing plate 530 may be coupled to each other in any scheme as long as coupling and separation between the base plate 510 and the first pressurizing plate 530 are possible, and the coupling between the base plate 510 and the first pressurizing plate 530 is able to be maintained as it is after the coupling.

The base plate 510 may further include the locking hook 542 for coupling with the second pressurizing plate 550. Although the locking hook 542 is illustrated as having an angled shape as an example, any shape may be used as long as the locking hook 542 is able to couple and separate the base plate 510 and the second pressurizing plate 550. The locking hook 542 is inserted into the locking hole 547 defined in the second pressurizing plate 550 to maintain the locking between the base plate 510 and the second pressurizing plate 550. The locking hole 547 may be located in the pressurizing surface 555, and the catch portion (not shown) coupled with the locking hook 542 may be located inside the locking hole 547.

A width of the base plate 510 may be greater than a width of the first pressurizing plate 530. Accordingly, portions that do not contact the first pressurizing plate of the coupling surface 511 that directly faces the first pressurizing plate of the base plate 510 exist near both side surfaces of the base plate 510. Because each locking hook 542 is located in the vicinity of each of the both side surfaces, when the base plate 510 and the first pressurizing plate 530 are coupled to each other, there will be no interference resulted from the locking hook 542.

Therefore, when the second pressurizing plate 550 is coupled to the base plate 510, the catch portion (not shown) located inside the locking hole 547 will come into contact with the locking hook 542 and be fastened thereto for the locking. In addition, for releasing the locking of the locking hook 542 and the catch portion, the locking hook 542 may come out of the locking hole 547 when pulling the handle 551. This is one of several possible methods. The second pressurizing plate 550 and the base plate 510 may be coupled to each other using a different method.

FIG. 4D shows a configuration in which, after mounting the pants P on the first pressurizing plate 530, the first pressurizing plate 530 is pivoted around the first shaft 5611 again to face the base plate 510. The first pressurizing plate 530 may further include a coupling member for coupling with the base plate 510. FIG. 4D shows a state in which the second pressurizing plate 550 is pivoted around the second shaft 5621 and the first pressurizing plate 530 and the base plate 510 are coupled to each other. Therefore, the pants P may be pressurized by the second pressurizing plate 550, the first pressurizing plate 530, and the base plate 510 after being mounted on the first pressurizing plate 530.

In addition, referring to FIG. 4A, the second clip 533 may be exposed to the outside even when the second pressurizing plate 550 is pivoted to face the first pressurizing plate 530 and closed. Because the second clip 533 is formed in a protruding form from the first pressurizing plate 530, in consideration of the same, a length in the height direction of the second pressurizing plate 550 may be smaller than a length in the height direction of the first pressurizing plate 530.

Although not shown in FIG. 4D, as will be described later, until the second pressurizing plate 550 pressurizes the pants through the pivoting, a portion of the pants positioned between the first pressurizing plate 530 and the base plate 510 may not be pressurized. That is, in the state in FIG. 4D, the first pressurizing plate 530 and the base plate 510 may face away from each other while the predetermined separation distance exists therebetween. However, unlike this, the portion the pants P positioned between the first pressurizing plate 530 and the base plate 510 may be pressurized as the first pressurizing plate 530 is pivoted and coupled to the base plate 510.

Referring to FIG. 4C, the base plate 510 may include the coupling surface 511 that pressurizes the pants mounted on the first pressurizing plate, and the mounting surface 512 positioned opposite to the coupling surface 511 to couple the base plate 510 to the door inner surface 401. Instead of the base plate 510, the door inner surface 401 may serve as the base plate 510. However, preferably, the base plate 510 may be spaced apart from the door inner surface 401 by a predetermined distance, and the base plate 510 may be coupled to the door inner surface using a support member (not shown). The support member may be an elastic member. This is to maintain a constant pressurizing force between the base plate 510 and the first pressurizing plate 530 to closely adhere the pants P.

When in close contact with the first pressurizing plate 530 without the mounted pants P, in order to prevent damage to the base plate 510 by the first clip 531 protruding from the first pressurizing plate 530, the base plate 510 may further include a clip accommodating portion 513 that is recessed into a shape corresponding to a shape of the first clip to accommodate the first clip 531 therein. The clip accommodating portion 513 may be in a recessed form or may be in a completely penetrated form.

Considering that the first clip 531 is located at the lower portion of the first pressurizing plate 530, the clip accommodating portion 513 may also be positioned at a lower portion of the base plate 510. Because the clip fixing portion 5311 of the first clip is located at the lower portion of the first pressurizing plate, a portion of the base plate corresponding to a portion of the clip accommodating portion 513 corresponding to the clip fixing portion of the first clip may be shorter than another portion of the base plate 510. That is, a first length P1 of the portion of the base plate corresponding to the clip fixing portion 5311 may be smaller than a second length P2 of another portion of the base plate.

Although not shown in the drawing, in order not to pressurize the sewing line of the pants P that is pressurized between the first pressurizing plate 530 and the base plate 510, the base plate 510 may also include a pressurizing prevention groove (not shown) defined therein at a position corresponding to the second groove 537 of the first pressurizing plate 530.

Figure 5A:
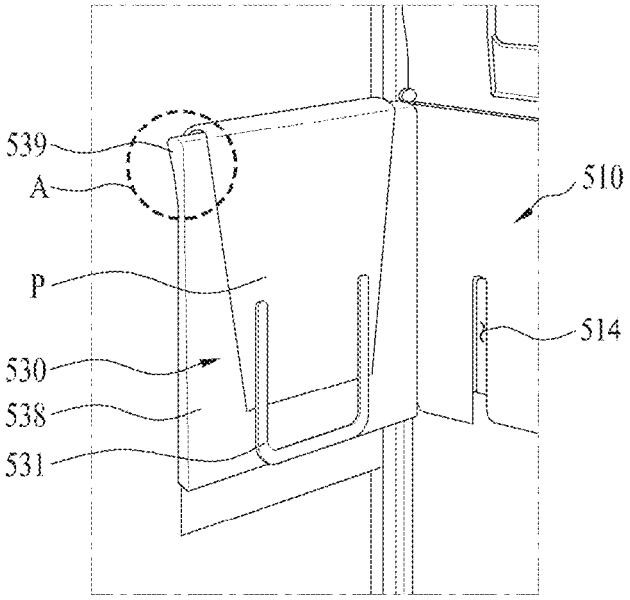
FIG. 5A shows that a mounting corner of a first pressurizing plate has an asymmetrical cross-section.
Figure 5B:
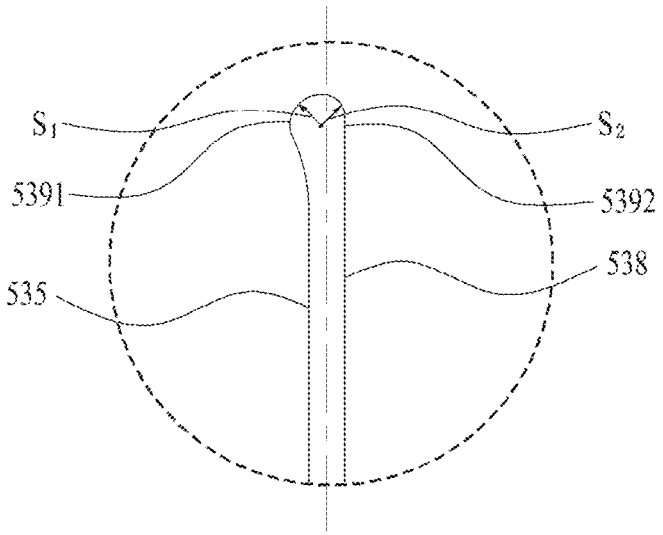
FIG. 5B is an enlarged view of a mounting corner.

FIG. 5A shows that the mounting corner 539 has an asymmetrical cross-section, and FIG. 5B is an enlarged view of the mounting corner 539.

Referring to FIG. 5A, the hem of the pants P may be fixed by the first clip 531 located on the second surface 538, and a middle portion of the pants may be mounted by a smooth curved surface of the mounting corner 539. Referring to FIG. 5A, the hem of the pants P may be fixed by the first clip 531 located on the second surface 538, and a middle portion of the pants may be mounted by a smooth curved surface of the mounting corner 539. Thereafter, the rest of the pants P may be mounted on the first surface 535. The rest of the pants P is longer than the first pressurizing plate 530, so that a portion of the pant waist of the pants P may be located below the lower portion of the first pressurizing plate 530. Therefore, the second clip 533 may insert both side surfaces of the pants respectively into the predetermined gaps 5331 and fix the both side surfaces of the pants without fixing the end of the pants P.

Because the mounting corner 539 has the curved surface, the unnecessary wrinkles or folds may be prevented from being generated even when the pants P are mounted.

Referring to FIG. 5B, the mounting corner 539 may include the first curved surface 5391 connected to the first surface 535, and the second curved surface 5392 connecting the first curved surface 5391 to the second surface 538. The first curved surface 5391 and the second curved surface 5392 may have the different curvatures and thus may have the asymmetrical shapes. That is, the first curved surface 5391 may have the shape that protrudes in the direction away from the door inner surface 401 than the first surface 535. Therefore, when a center of the first pressurizing plate is indicated by a dashed-dotted line, a radius of curvature S1 of the first curved surface 5391 may be greater than a radius of curvature S2 of the second curved surface 5392 based on the dashed-dotted line. In other words, a curvature of the first curved surface 5391 may be smaller than a curvature of the second curved surface 5392. The radius of curvature of the second curved surface 5392 is similar to half the thickness of the first pressurizing plate 530, but the radius of curvature of the first curved surface 5391 may be greater than half the thickness of the first pressurizing plate 530.

In one example, the total length (a length of an outer seam) of the pants P may be greater than a sum of a length of the first surface 535, a length of the mounting corner 539, and a length of the second surface 538. In this case, the pant waist of the pants may be located lower the second clip 533. From the hem of the pants P to a middle portion of the pant leg will be pressurized through the base plate 510 and the second surface, and the rest of the pants including the pant waist (the portion excluding the pant legs) of the pants will be mounted on the first surface 535 after passing through the mounting corner 539. In this connection, a portion to actually remove the folds is not the pant waist, but the pant legs. In addition, a position of the sewing line the pant waist may be different from that of the pant legs. Therefore, a place where the wrinkle removal through actual pressurizing is required will be the pant legs except for the pant waist.

Therefore, by increasing the radius of curvature of the first curved surface 5391 in order to pressurize only a desired portion of the mounted pants P, the portion of the pants located between the second surface 538 and the base plate 510 is all pressurized to remove the folds, and a tension is generated by a self load of the rest of the pants past the mounting corner 539, so that the pants will be pressurized in a very straight and taut state throughout, which will make the intended wrinkles (the creases) of the pants clearer and more prominent. Such creases are also referred to as "clearly visible pants' leg creases".

Considering the radius of curvature of the first curved surface 5391, after passing through the first curved surface 5391, the pants P will be spaced apart from the first pressurizing plate 530 unless the second pressurizing plate 550 is coupled to the first pressurizing plate 530. In one example, depending on a shape of the second pressurizing plate 550, the portion of the pants P located between the first surface 535 and the second pressurizing plate 550 may also be pressurized.

Figure 6A:
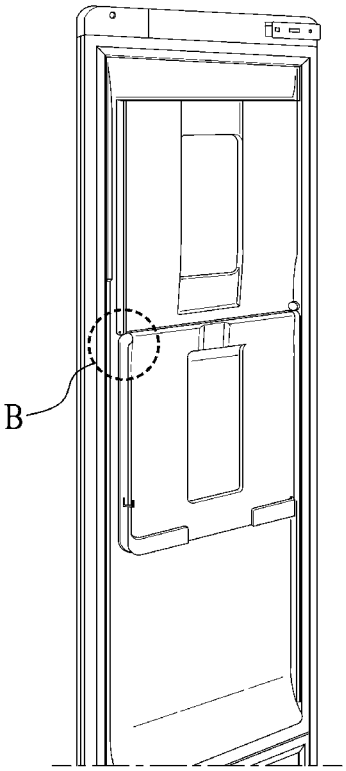
FIG. 6A shows positions of a first pivoting portion and a second pivoting portion.
Figure 6B:
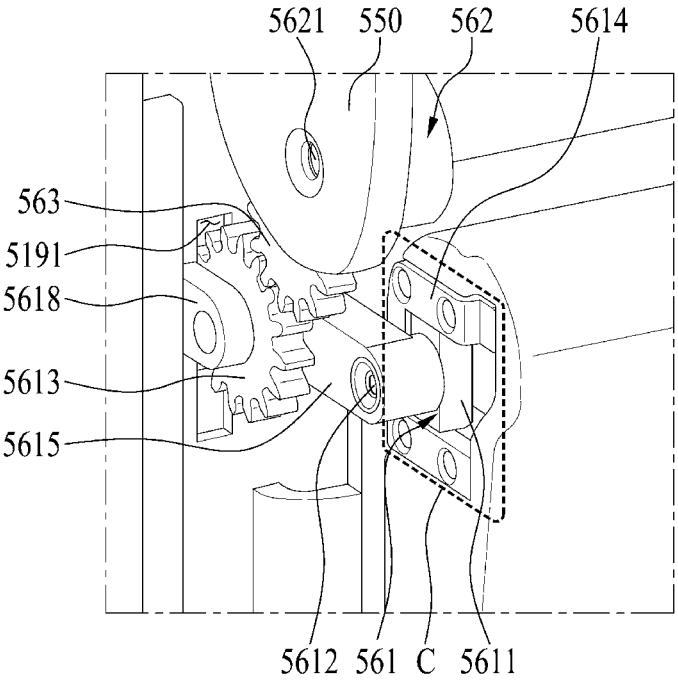
FIG. 6B is an enlarged view of a first pivoting portion and a second pivoting portion.

FIG. 6A shows a place where a first pivoting portion 561 and a second pivoting portion 562 are located. FIG. 6B is an enlarged view of the first pivoting portion 561 and the second pivoting portion 562.

As described above, the first pressurizing plate 530 may pivot in the left and right direction of the door 400 around the first shaft 5611, and the second pressurizing plate 550 may pivot in the vertical direction of the door 400 around the second shaft 5621. In addition, when the second pressurizing plate is pivoted and opened, the first pressurizing plate 530 also pivots in the same direction, so that the pants may become unpressurized from the state of being pressurized by the first pressurizing plate 530 and the base plate 510.

To enable such pivoting, the first pressurizing plate 530 may further include the first pivoting portion 561 that is coupled to the door inner surface 401 or the base plate 510 to pivot the first pressurizing plate 530 around the first shaft 5611 and in a direction perpendicular to the first shaft 5611.

The second pressurizing plate 550 may further include the second pivoting portion 562 that is coupled to the door inner surface 401 or the base plate 510 to pivot the second pressurizing plate around the second shaft, that is, the direction perpendicular to the first shaft.

The first pivoting portion 561 may include the first shaft 5611 constructed in the height direction of the door 400, the auxiliary shaft 5612 vertically connected to the first shaft 5611, and a connecting portion 5615 pivotably connected to the auxiliary shaft 5612. Accordingly, the first pressurizing plate 530 may pivot in the left and right direction of the door 400 through the first shaft 5611 and also in the vertical direction of the door 400 through the auxiliary shaft 5612.

In addition, the first pivoting portion 561 may further include a fixing portion 5614 for fixing the first shaft 5611 to one side surface of the first pressurizing plate. Because there is the fixing portion 5614 in a bracket shape having a shaft depression 534 that may accommodate the first shaft 5611 therein, and fixing the first shaft 5611 inserted into the shaft depression 534 is formed on one side surface of the first pressurizing plate, the first shaft 5611 may be fixed inside the shaft depression 534. Accordingly, the first pressurizing plate 530 may pivot in the left and right direction of the door around the first shaft 5611.

The auxiliary shaft 5612 may extend perpendicularly to the first shaft 5611 and protrude through the fixing portion 5614. The first shaft 5611 and the auxiliary shaft 5612 may be integrally formed. The first shaft 5611 and the auxiliary shaft 5612 will eventually have a shape in which two cylinder-shaped shafts are coupled to each other in a T shape. Accordingly, both the pivoting by the first shaft 5611 and the pivoting by the auxiliary shaft 5612 of the first pressurizing plate 530 may become possible.

The first pivoting portion 561 may further include the connecting portion 5615 connected to the auxiliary shaft 5612, a first gear 5613 coupled to the connecting portion to transmit a pivoting force, a first gear shaft 56131 that is a pivoting shaft of the first gear 5613, and a first support 5618 that supports the first gear shaft 56131 by being coupled to the door inner surface 401 or the base plate 510.

The first gear 5613 and the connecting portion 5615 may be coupled to each other such that the connecting portion 5615 pivots together when the first gear 5613 pivots. Accordingly, when the first gear 5613 pivots, the connecting portion 5615 will pivot, and eventually, the first pressurizing plate 530 will pivot in the same direction around the auxiliary shaft 5612. In this connection, the first pressurizing plate 530 will pivot with a radius corresponding to a length of the connecting portion 5615. In addition, because of a self load of the first pressurizing plate 530, the first pressurizing plate 530 will pivot while always facing the base plate 510 in parallel as in FIGS. 8A to 8D. That is, simply because the connecting portion 5615 pivots, the auxiliary shaft 5612 connected to the connecting portion 5615 moves along a trajectory of the connecting portion in response to the pivoting of the connecting portion 5615, so that the base plate 510 seems to pivot. However, an angle between the first pressurizing plate 530 and the base plate 510 actually does not change by the pivoting. From a point of view of vector calculus, a value of a curl vector of the base plate based on the pivoting of the base plate will be zero. However, because the base plate 510 seems to pivot, the base plate 510 is described as pivoting throughout this specification.

The second pivoting portion 562 may include the second shaft 5621 for pivoting the second pressurizing plate 550 in the vertical direction of the door or in the direction perpendicular to the first shaft, and a second gear 5623 that pivots around the second shaft 5621 together with the second pressurizing plate 550. In addition, the second gear 5623 and the second shaft 5621 may be integrally formed. A second gear shaft constituting a pivoting center of the second gear 5623 may be formed as a different shaft from the second shaft 5621. However, herein, a case in which the second gear shaft is the same as the second shaft for the pivoting of the second pressurizing plate is illustrated as an example.

When the second pressurizing plate 550 pivots, because the second gear 5623 and the second shaft 5621 are coupled to the second pressurizing plate 550, the second gear 5623 and the second shaft 5621 may pivot together. The second pressurizing plate 550 may further include a second support 5625 coupled to the door inner surface 401 or the base plate 510 to support the pivoting of the second gear shaft.

Figure 7C:
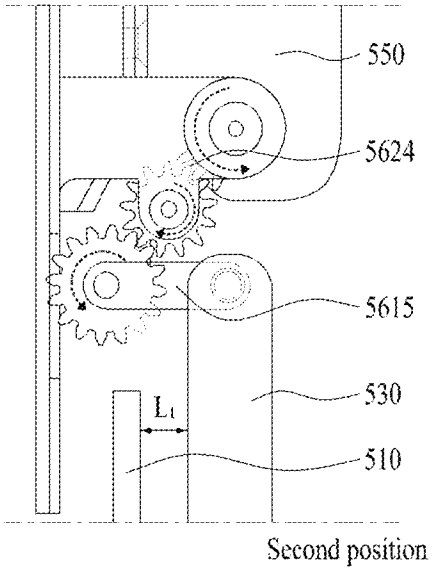
FIGS. 7B and 7C show a mechanism in which a first pressurizing plate pivots when a second pressurizing plate pivots as a pivoting force is transmitted through a first gear, a connecting portion, and an auxiliary shaft when a second gear pivots.
Figure 7B:
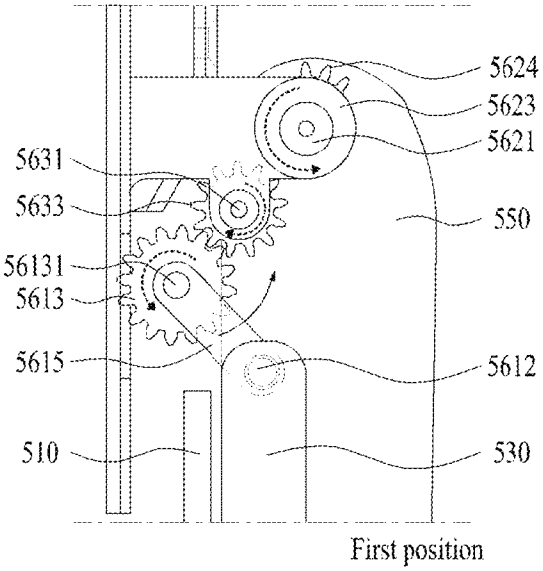

Referring to FIG. 7B, the first support 5618 may not only support the first gear 5613, but also support a third gear 5633 that is an idle gear positioned between the first gear 5613 and the second gear 5623. The third gear 5633 is to prevent a diameter of the first gear 5613 or the second gear 5623 from increasing when a distance between the first gear and the second gear 5623 is great. Accordingly, the first gear 5613 and the second gear 5623 may be directly meshed. However, herein, the first gear 5613 and the second gear 5623 are illustrated to be indirectly connected to each other using the third gear 5633 as an example.

Referring to FIG. 6B, the base plate 510 may further include a gear through-hole 5191 penetrating the base plate 510 in the thickness direction at a position corresponding to the first gear 5613. This is to prevent collision or interference with the base plate resulted from a size of the first gear 5613. In addition, because the base plate 510 is spaced apart from the door inner surface 401 by a predetermined distance as described above, even though the first gear 5613 protrudes toward the mounting surface, the first gear 5613 will not reach the door inner surface 401 because of the gear through-hole 5191.

Figure 7A:
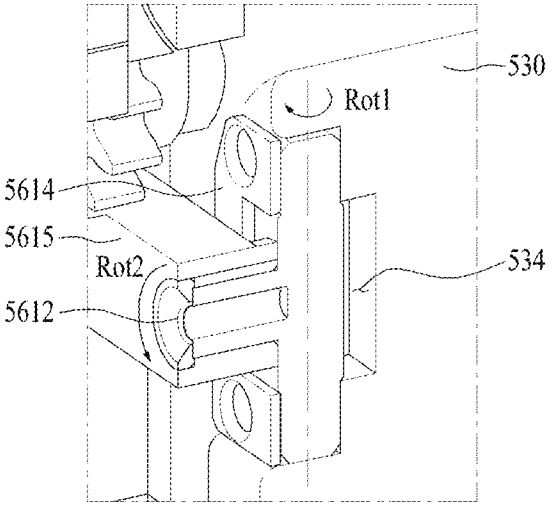
FIG. 7A is an enlarged view of a first shaft, an auxiliary shaft, and a connecting portion.

FIG. 7A is an enlarged view of the first shaft, the auxiliary shaft, and the connecting portion. FIGS. 7B and 7C show a mechanism in which the first pressurizing plate pivots when the second pressurizing plate pivots as the pivoting force is transmitted through the first gear, the connecting portion, and the auxiliary shaft when the second gear pivots.

Referring to FIG. 7A, the first pressurizing plate 530 may pivot in a left and right direction Rot1 by the first shaft 5611 formed in parallel with the height direction of the door. A dashed-dotted line indicates a center in a cross-section of the first shaft 5611. In addition, the first pressurizing plate 530 may also pivot in a vertical direction Rot2 by the auxiliary shaft 5612 formed perpendicular to the first shaft 5611.

FIG. 7B shows a case in which the pressurizing surface 555 of the second pressurizing plate 550 is positioned to face the first pressurizing plate 530, and thus, the second pressurizing plate 550 is coupled to the first pressurizing plate 530 or the base plate 510 to pressurize the mounted pants. In this connection, the first pressurizing plate will obviously pressurize the base plate 510 and the pants. When there is no mounted pants, first pressurizing plate will be in close contact with the base plate 510. A position of the first pressurizing plate at this time will be referred to as a first position.

FIG. 7C shows a case in which the user opens the second pressurizing plate 550, that is, pivots the second pressurizing plate 550 around the second shaft 5621, and thus, the cover surface 558 faces the door inner surface 401. In this connection, the first pressurizing plate 530 may pivot by the pivoting of the connecting portion 5615. However, the first pressurizing plate 530 will always be separated by a predetermined separation distance from the base plate 510 while facing the base plate 510 by the self load of the first pressurizing plate 530. A position of the first pressurizing plate at this time will be referred to as a second position.

When the user opens the second pressurizing plate 550, the handle 551 of the second pressurizing plate 550 will be positioned above the second shaft 5621 after being positioned below the second shaft 5621. The pressurizing surface 555 will be exposed to the outside, and the cover surface 558 will face the door inner surface 401 from a state in which the pressurizing surface 555 faces the base plate 510 and the cover surface 558 is exposed to the outside.

In one example, the handle 551 may be not only means for holding the second pressurizing plate 550 to pivot the same, but may also release the coupling between the second pressurizing plate 550, the base plate 510, and the first pressurizing plate 530. That is, when the user pulls the handle 551, the lock of the locking device (not shown) that maintains the coupling between the second pressurizing plate 550, the base plate 510, and the first pressurizing plate 530 may be released.

When the user opens the second pressurizing plate 550, the first pressurizing plate 530 will move from the first position to the second position. When the second pressurizing plate 550 pivots, the second gear 5623 will pivot in a first pivoting direction in the same manner as the second pressurizing plate 550. When the second gear 5623 pivots, the third gear 5633 will pivot in a pivoting direction opposite to the first pivoting direction. Then, the first gear 5613 will pivot in the first pivoting direction.

When the first gear 5613 pivots in the first pivoting direction, the connecting portion 5615 coupled thereto may pivot in the first pivoting direction. In this connection, the auxiliary shaft 5612 pivotably connected to the connecting portion 5615 will be moved along the first pivoting direction by the connecting portion 5615. Therefore, the first pressurizing plate 530 will also move along the first pivoting direction through the first shaft 5611 connected to the auxiliary shaft 5612. Therefore, in the end, as shown in FIG. 7C, the base plate 510 and the first pressurizing plate may face away from each other while maintaining a predetermined separation distance L1 at the second position. The separation distance will be a maximum distance between the base plate 510 and the first pressurizing plate 530. In addition, at the first position, the separation distance will be smaller than a distance between the first gear shaft 56131 and the auxiliary shaft 5612.

Referring to FIGS. 7B and 7C, the second gear 5623 has gear teeth 5624 only on a portion of an outer circumferential surface of the second gear. This is to limit a portion engaged with the third gear 5633 to the portion where the gear teeth are formed. That is, when the gear teeth are formed on an entire outer circumferential surface of the second gear 5623, because the first pressurizing plate 530 immediately pivots at the first position when the second pressurizing plate 550 pivots, finally, the first pressurizing plate 530 may be positioned much higher than the second position. In this case, interference with the first support 5618 and the like may occur. Therefore, in order to prevent unnecessary movement of the first pressurizing plate 530, that is, in order to allow the first pressurizing plate 530 to be movable only between the first position and the second position, the gear teeth 5624 of the second gear may be formed only on the portion of the outer circumferential surface of the second gear 5623. In this case, when the second pressurizing plate 550 pivots, the first pressurizing plate 530 will not pivot immediately, but the first pressurizing plate 530 will pivot with a certain delay time. FIG. 7C shows a state in which the gear teeth of the second gear mesh with gear teeth of the third gear at the second position.

The same applies when the user pivots and closes the second pressurizing plate 550. In this case, the first pressurizing plate 530 will start to pivot simultaneously with the pivoting of the second pressurizing plate 550 at the second position, and the second pressurizing plate 550 will be coupled to the first pressurizing plate 530 and the base plate 510 after a predetermined time delay after the first pressurizing plate 530 reaches the first position. That is, the pressurizing surface 555 will be coupled to the first pressurizing plate 530 to face thereto.

In this connection, unlike the presser 50 (see FIGS. 1A and 1B) disposed in the conventional laundry treating apparatus 2000, the first pressurizing plate 530 pressurizes the pants P while facing the base plate 510 in parallel, so that it is possible to evenly pressurize the pants at once. Therefore, it is possible to minimize a pushed phenomenon of the pants caused as the pants are pressurized starting from one side thereof resulted from the pivoting, and the folds resulted therefrom.

FIGS. 8A to 8D schematically shows a state in which the first pressurizing plate 530 pivots in the vertical direction of the door by the connecting portion 5615 and an auxiliary connecting portion 5715 such that the pants P may be mounted between the first pressurizing plate 530 and the base plate 510.

As described in FIGS. 7A to 7C, the first pressurizing plate 530 may pivot while facing the base plate 510 when pivoting by the connecting portion. This is because the angle between the first pressurizing plate 530 and the base plate 510 does not change when the connecting portion 5615 pivots by the self load of the base plate 510. To further ensure the same, the auxiliary connecting portion 5715 may be further included below the connecting portion on one side surface onto which the connecting portion is connected among both side surfaces of the first pressurizing plate 530.

Unlike the connecting portion 5615 having the first gear 5613 to receive the pivoting force when the second pressurizing plate 550 pivots, the auxiliary connecting portion 5715 is simply hinged to the base plate 510 or the door inner surface 401 to pivot. Therefore, when the connecting portion 5615 actively pivots the first pressurizing plate 530, in the case in which the first pressurizing plate 530 is pivoted by the connecting portion 5615, the auxiliary connecting portion 5715 will always serve to manually guide the base plate 510 to pivot while facing the first pressurizing plate 530.

In addition, the connecting portion 5615 and the auxiliary connecting portion 5715 should be disposed on only one side surface of the first pressurizing plate 530. This is because the first pressurizing plate 530 must also pivot through the first shaft 5611.

Figures 8A, 8B, 8C, 8D:
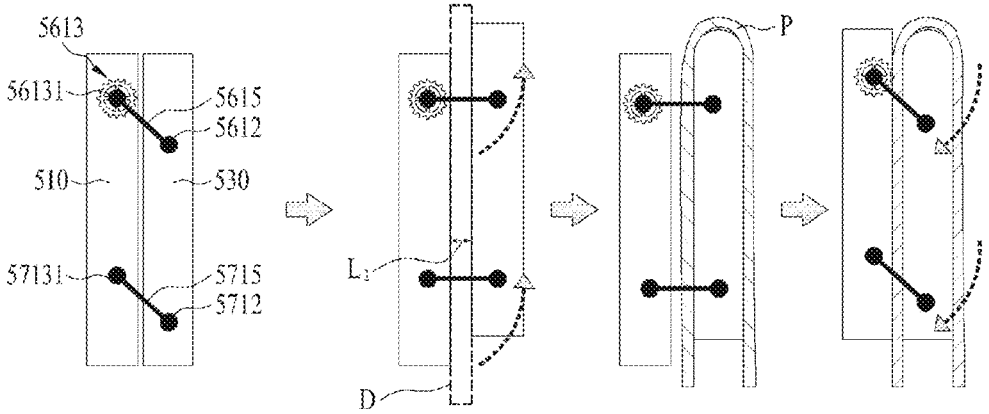
FIGS. 8A to 8D schematically shows a state in which a first pressurizing plate pivots in a vertical direction of a door by a connecting portion and an auxiliary connecting portion such that laundry may be mounted between the first pressurizing plate and a base plate.

FIG. 8A schematically shows the first pressurizing plate 530, the connecting portion 5615, and the auxiliary connecting portion 5715 at the first position. The auxiliary connecting portion 5715 may include a subordinate shaft 57131 for hinged coupling to the base plate 510 or the door inner surface 401, and a subordinate auxiliary shaft 5712 disposed in parallel with the auxiliary shaft 5612 for pivoting the first pressurizing plate 530. Roles of the subordinate shaft 57131 and the subordinate auxiliary shaft 5712 may be the same as the roles of the first gear shaft 56131 and the auxiliary shaft 5612.

FIG. 8B shows that the first pressurizing plate 530 is moved to the second position, and the first pressurizing plate 530 and the base plate 510 are separated by a predetermined separation distance L1. Thereafter, the user will pivot the first pressurizing plate 530 through the first shaft 5611, and then mount and fix the pants on the first pressurizing plate 530 using the first clip 531 and the second clip 533. Then, when the first pressurizing plate 530 is pivoted in the opposite direction again, the pants P will be positioned between the base plate 510 and the first pressurizing plate 530 as shown in FIG. 8C. Thereafter, as in FIG. 8D, when the second pressurizing plate 550 is pivoted downward, the first pressurizing plate 530 will pressurize the pants P while moving from the second position to the first position.

The present disclosure is able to be implemented in various forms, so that a scope thereof is not limited to the above-described embodiment. Therefore, when the modified embodiment includes the components in claims of the present disclosure, the modified embodiment should be viewed as belonging to the scope of the present disclosure.

What is claimed is:

1. A laundry treating apparatus comprising:
- a cabinet having a laundry inlet defined in one surface thereof;
- a chamber positioned inside the cabinet to accommodate laundry therein through the laundry inlet;
- a door pivotably coupled to the cabinet to open and close the laundry inlet;
- a door inner surface facing the chamber among both surfaces of the door;
- a base plate coupled to the door inner surface;
- a first shaft disposed parallel to a height direction of the door;
- a second shaft disposed perpendicular to the height direction of the door;
- a first pressurizing plate configured to provide a space configured to mount pants, the first pressurizing plate being pivotably coupled to the door inner surface or the base plate through the first shaft and configured to face the base plate;
- a second pressurizing plate pivotably coupled to the door inner surface or the base plate through the second shaft and disposed to face the first pressurizing plate; and
- a clip portion provided in the first pressurizing plate and configured to fix the pants to the first pressurizing plate,
- wherein the first pressurizing plate has a first surface and a second surface opposite to the first surface, the first pressurizing plate being configured to press (i) a first portion of the pants between the base plate and the first surface of the first pressurizing plate and (ii) a second portion of the pants between the second surface of the first pressurizing plate and the second pressurizing plate.

2. The laundry treating apparatus of claim 1, wherein the clip portion includes a first clip located at the first surface facing the base plate to fix a portion of the pants to the first surface.

3. The laundry treating apparatus of claim 2, wherein the clip portion further includes a second clip located at the second surface facing the second pressurizing plate to fix another part of the pants to the second surface.

4. The laundry treating apparatus of claim 3, wherein the second clip has an angled shape and defines a predetermined gap with the first pressurizing plate, and
- wherein the second clip is configured to fix the pants by inserting a portion of one side surface of the pants into the predetermined gap.

5. The laundry treating apparatus of claim 3, wherein a length of the second pressurizing plate is less than a length of the first pressurizing plate, and
- wherein the second clip is configured to be exposed out of the first pressurizing plate when the second pressurizing plate is pivotably coupled to the first pressurizing plate.

6. The laundry treating apparatus of claim 3, wherein the first pressurizing plate further includes:
- a mounting corner having a curved shape and connecting the first surface and the second surface to each other, wherein the mounting corner is configured to mount the pants, and
- wherein the mounting corner has (i) a first curved surface that is connected to the first surface and that has a first curvature and (ii) a second curved surface that is connected to the second surface and that has a second curvature different from the first curvature.

7. The laundry treating apparatus of claim 6, wherein the mounting corner is connected to the first surface with the first curved surface and protrudes toward the second pressurizing plate.

8. The laundry treating apparatus of claim 7, wherein the first surface includes a first groove recessed in a longitudinal direction of the door to prevent interference with a seam formed on the pants, and
- wherein the second surface includes a second groove recessed in the longitudinal direction of the door to prevent the interference with the seam formed on the pants.

9. The laundry treating apparatus of claim 1, wherein the base plate is spaced apart from the door inner surface by a predetermined separation distance and is coupled to the door inner surface.

10. The laundry treating apparatus of claim 2, wherein the base plate includes a clip accommodating portion recessed or penetrated into a shape corresponding to a shape of the first clip when the first pressurizing plate pressurizes the base plate.

11. The laundry treating apparatus of claim 1, wherein a width of the second pressurizing plate is greater than widths of the first pressurizing plate and the base plate.

12. The laundry treating apparatus of claim 11, further comprising:
- a blower configured to suction air in the chamber;
- a heat pump configured to dehumidify and heat the suctioned air;
- a first opening penetrating the first pressurizing plate in a thickness direction; and
- a second opening penetrating the second pressurizing plate in the thickness direction at a position corresponding to a position of the first opening,
- wherein the pants are exposed to dehumidified and heated air through the first opening and the second opening.

13. The laundry treating apparatus of claim 12, wherein the second pressurizing plate includes protective side surfaces formed by being bent in a direction toward the door inner surface from both side surfaces of the second pressurizing plate, respectively.

14. The laundry treating apparatus of claim 13, wherein a cover surface located on a side away from the door inner surface among both surfaces of the second pressurizing plate further includes a handle for a user to hold the second pressurizing plate to pivot the second pressurizing plate.

15. The laundry treating apparatus of claim 1, further comprising:

a first opening penetrating the first pressurizing plate in a thickness direction;

a second opening penetrating the second pressurizing plate in the thickness direction at a position corresponding to a position of the first opening; and a steamer configured to generate steam and to supply the generated steam to the chamber.

16. The laundry treating apparatus of claim 2, wherein the first clip is disposed at a lower portion of the first surface.

17. The laundry treating apparatus of claim 3, wherein the second clip is disposed at a lower portion of the second surface.

* * * * *